United States Patent [19]

Ueda et al.

[11] Patent Number: 4,732,530

[45] Date of Patent: Mar. 22, 1988

[54] TURBOMOLECULAR PUMP

[75] Inventors: Shinjiroo Ueda, Abiko; Takeshi Okawada, Ibaraki; Osami Matsushita, Ibaraki; Kazuaki Nakamori, Ibaraki, all of Japan

[73] Assignee: Hitachi, Ltd., Tokyo, Japan

[21] Appl. No.: 758,462

[22] Filed: Jul. 24, 1985

[30] Foreign Application Priority Data

Jul. 25, 1984 [JP] Japan ..... 59-152812

[51] Int. Cl.[4] ..... F01D 1/36

[52] U.S. Cl. ..... 415/90

[58] Field of Search ..... 415/90, 143, 169 A, 415/170 B

[56] References Cited

U.S. PATENT DOCUMENTS

| | | | |
|---|---|---|---|
| 1,069,408. | 8/1913 | Gaede | 415/90 |
| 1,980,589 | 11/1934 | Acree | 415/90 |
| 2,918,208 | 12/1959 | Becker | 415/90 |
| 3,138,318 | 6/1964 | Garnier et al. | 415/90 |
| 3,472,518 | 10/1969 | Harlan | 415/73 |
| 3,751,908 | 8/1973 | Colwell et al. | 415/90 |
| 3,969,039 | 7/1976 | Shoulders | 415/90 |
| 4,270,882 | 6/1981 | Luijten et al. | 415/90 |

FOREIGN PATENT DOCUMENTS

| | | | |
|---|---|---|---|
| 966442 | 7/1957 | Fed. Rep. of Germany | 415/170 R |
| 1093628 | 11/1960 | Fed. Rep. of Germany | 415/170 R |
| 2311461 | 9/1974 | Fed. Rep. of Germany | 415/73 |
| 329205 | 6/1910 | France | 415/212 |
| 125795 | 7/1985 | Japan | 415/90 |
| 182394 | 9/1985 | Japan | 415/90 |
| 13004 | 6/1906 | United Kingdom | 415/170 R |

*Primary Examiner*—Robert E. Garrett
*Assistant Examiner*—John T. Kwon
*Attorney, Agent, or Firm*—Antonelli, Terry & Wands

[57] ABSTRACT

A turbomolecular pump for evacuating a space by a plurality of turbine grooves located on a rotor and a stator located in face-to-face relationship to the rotor, with the turbine grooves, including rotor grooves on an outer peripheral surface of a rotor extending peripherally at a predetermined angle with respect to the axis of the rotor, and stator grooves on a surface of a stator facing the rotor which extend at the same angle as the rotor grooves but are oriented in an opposite direction to the rotor grooves. The rotor grooves and stator grooves overlap in part as viewed axially of the rotor. A pumping action is performed by surfaces of blades of an axial flow turbomolecular pump and a pumping action is performed by the rotor and the bottom surface of the groove of a helical groove turbomolecular pump, whereby a high compression ratio and a high gas discharge or evacuation speed can be achieved.

10 Claims, 7 Drawing Figures

TURBOMOLECULAR PUMP

BACKGROUND OF THE INVENTION

This invention relates to turbomolecular pumps, and more particularly it deals with a turbomolecular pump suitable for use in achieving a high degree of compression of gas and a high gas discharge speed.

Generally, an evacuated chamber in which a high vacuum is achieved is necessary for a nuclear fusion system, a semiconductor manufacturing apparatus, an electron microscopic device, etc, and to attain the end of providing an evacuated chamber of high vacuum, it has been proposed to employ a turbomolecular pump which exhibits a high pumping performance in a molecular flow.

There are basically two types of turbomolecular pumps, namely, an axial flow molecular pump and a helical groove molecular pump.

An axial flow molecular pump comprises multi-stage axial flow turbines each comprising rotor blades and stator blades of mirror image configuration which are located symmetrically and alternately in an axial direction. In axial flow molecular pumps, the rotor blades are rotated at high speed to impart a specific direction to gas molecules, to evacuate a space. It is surfaces of the blades of rotors and stators that imparts the direction to the gas molecules, and wall surfaces of the rotors at the bottom of the rotor blades and wall surfaces of a casing facing forward ends of the rotor blades are not concerned in the pumping action.

Although this type of molecular pump offers the advantage that a high pumping speed is obtainable, it suffers the disadvantage in that it has a low compression ratio per stage, thereby making it necessary to arrange blades in a plurality of stages, to obtain a high compression ratio. Thus, when this type of molecular pump is employed, it is the usual practice to employ turbines arranged in ten-odd stages. Difficulty has, therefore, been experienced in achieving a high speed in rotation because of a heavy weight of the rotating mass. Moreover, the use of turbines of a plurality of stages requires a large number of personnel and increases the time of manufacturing. In addition, the need to use a half structure for the row of stators to facilitate an assembly of the pump increases the production cost.

Meanwhile, a helical groove molecular pump comprises a casing, and a rotary inner cylinder and a stationary outer cylinder located in the casing in face-to-face relation to each other, with the outer casing being formed with a helical groove. Rotation of the rotary inner cylinder at high speed causes the surface of the inner cylinder to impart direction to gas molecules, and the gas molecules are guided to flow along the helical groove, to thereby discharge gas. Pumping can be effected on the same principle by forming a helical groove on the surface of the rotary inner cylinder and rotating the inner cylinder within the outer cylinder. The helical groove molecular pump is distinct from the axial flow molecular pump in that, whereas, the pumping action is performed by the surfaces of the blades in the latter, this action is performed by the surface of the inner cylinder facing the helical groove on the outer cylinder in the former.

The helical groove molecular pump is simple in construction and can be readily fabricated. However, in a helical groove type of molecular pump, the pumping speed is reduced as an exponential function of the depth of the helical groove, and thereby restricting the application of the helical groove type of molecular pump to vacuum devices to which the pumping speed is not essential.

An added disadvantage of the helical groove molecular pump is that an increase in the gap between the rotary inner cylinder and the outer cylinder formed with the helical groove results in a sudden decline in performance.

Thus, the axial flow molecular pump is more favored than the helical groove molecular pump except for those applications whose purposes can be better served by the latter. It has been proposed in, for example, Japanese Patent Publication No. 33446/77, to use a compound type turbomolecular pump which avoids the disadvantages of the two types of molecular pumps and utilizes their advantages. However, no one type of turbomolecular pump has ever been successful in solving the above described problems of the prior art.

This invention has as its object the provision of a novel type of turbomolecular pump capable of achieving a high compression ratio and a high pumping speed.

In accordance with the present invention a turbomolecular pump is provided wherein a pumping action is performed by a plurality of grooves on a rotor located in a casing and extending axially thereof, and a plurality of grooves on a stator located in the casing in face-to-face relation to the rotor. The features of the invention include a plurality of rotor grooves on an outer peripheral surface of the rotor extending equidistantly spaced-apart relation to each other and tilting at a predetermined angle with respect to the axis of the rotor, and a plurality of stator grooves on a surface of the stator facing the rotor which extend equidistantly spaced-apart relation to each other and tilt at the same angle as the rotor grooves but are oriented in an opposite direction to the rotor grooves, with the rotor grooves and stator grooves overlapping in part as viewed axially of the rotor. The turbomolecular pump having the above-described features is connected at its discharge side to a vacuum device of a nuclear fusion system or the like, and the rotor is rotated at high speed to allow a pumping action to be performed between the rotor grooves and stator grooves, to produce a high vacuum in the vacuum device. The turbomolecular pump of this construction and operation performs both the pumping action which is performed by the surfaces of the blades in an axial flow molecular pump and the pumping action which is performed by the rotor and the bottom surface of the groove in the helical groove molecular pump, whereby a high compression ratio and a high pumping speed can be obtained.

DETAILED DESCRIPTION

Figure 1:
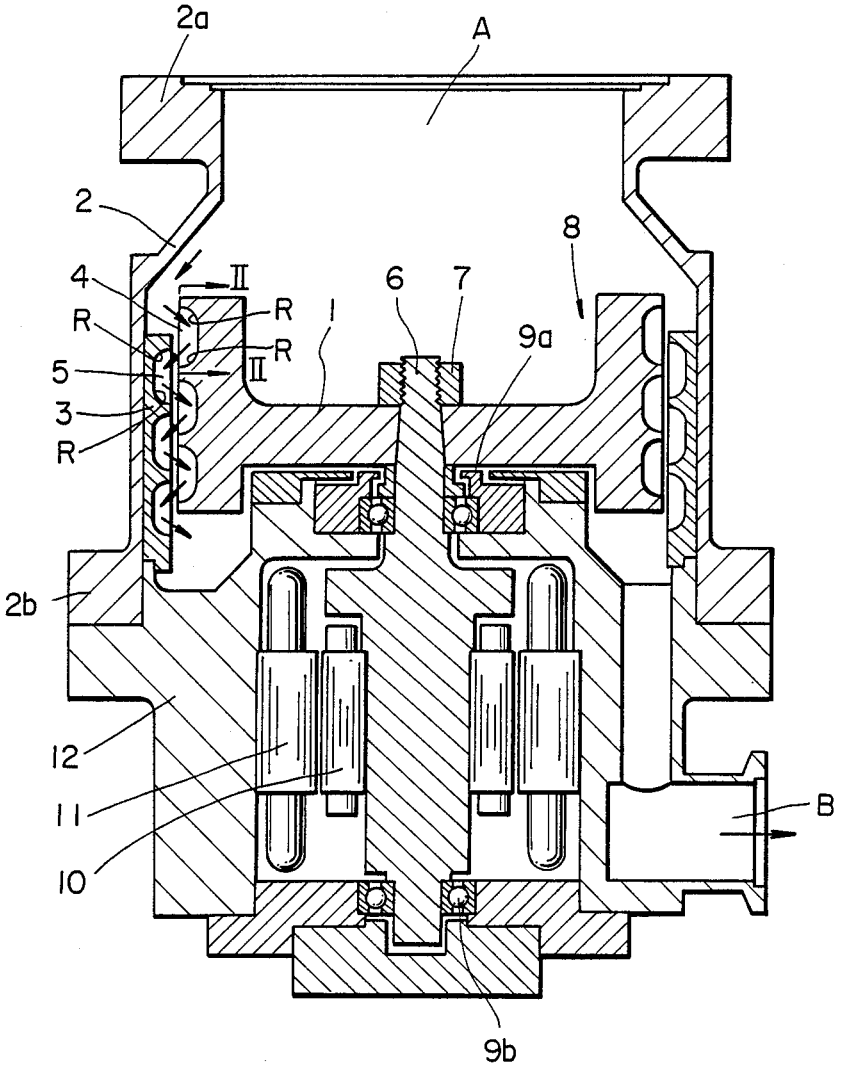
FIG. 1 is a vertical sectional view of a first embodiment of the turbomolecular pump in accordance with the invention.

Referring now to the drawings wherein like reference numerals are used throughout the various views to designate like parts and, more particularly, to FIG. 1, according to this figure, a rotor 1, of substantially cylindrical configuration, is located in a casing 2 and extends substantially axially, with a stator 3 also being located in the casing 2 and arranged in a face-to-face relationship to the rotor 1. A plurality of rotor grooves 4 are formed on an outer peripheral surface of the rotor 1, and stator grooves 5 are formed on a surface of the stator 3 facing the rotor 1. The rotor 1 is secured by a nut 7 to a rotary shaft 6 rotatably journalled by bearings 9*a* and 9*b*, to provide a unitary rotary member 8. Mounted to the rotary shaft 6 is a motor rotor 10 which faces a motor stator 11 located in a discharge casing 12 formed with a discharge port B.

The casing 2 is formed with a suction port A at its upper portion which has a flange 2*a* for connecting the casing 2 to a vacuum device, not shown, in which a high vacuum is to be achieved. The casing 2 has at its lower end portion a flange 2*b* for connecting the casing 2 to the discharge casing 12.

Figure 2:
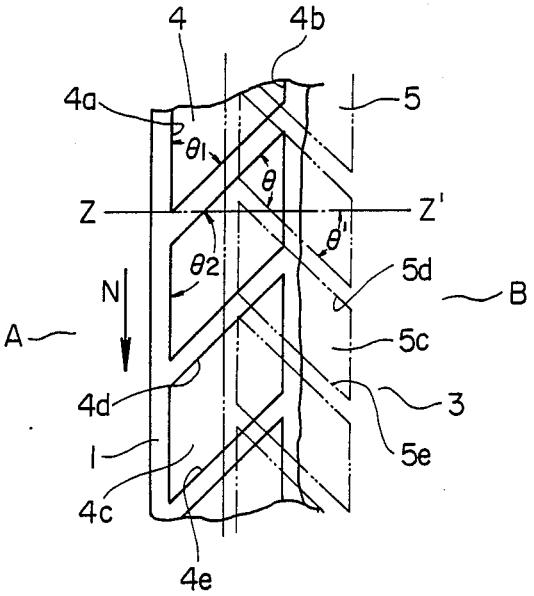
FIG. 2 is a developed view taken in the drection of arrows II—II in FIG. 1.

As shown in detail in FIG. 2, a starting end 4*a* and a terminating end 4*b* of each rotor groove 4, formed on the outher peripheral surface of the rotor 1 in a manner to tilt at an angle $\theta$ with respect to the center axis Z—Z' of the rotor 1, are parallel to each other peripherally of the rotor 1. Each rotor groove 4 also has a bottom surface 4*c* and opposite side surfaces 4*d* and 4*e*. Thus, the starting end 4*a* and one side surface 4*e* form an acute angle $\theta_1$, and the starting end 4*a* and the other side surface 4*d* form an obtuse angle $\theta_2$. The stator grooves 5 tilt at an angle $\theta'$ with respect to the center axis Z—Z' of the rotor 1 but are oriented in an opposite direction to the rotor grooves 4. The rotor grooves 4 and stator grooves 5 are arranged to overlap in part as viewed axially of the rotor 1. From the starting end 4*a* to the terminating end 4*b*, each rotor groove 4 is curved as indicated at R from one side surface 4*d* to the other side surface 4*e* through the bottom surface 4*c* in cross section.

In the above-described construction, when an electric current is passed to the motor stator 11, the rotary member 8 is rotated through the motor rotor 10 in a direction N at high speed, to allow the turbomolecular pump to start its operation.

Figure 3:
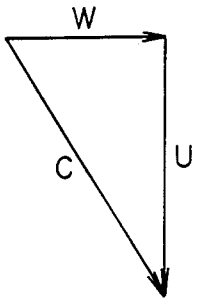
FIG. 3 is a graphical illustration of the flow of gas molecules in the rotor grooves shown in FIG. 1.

Gas molecules introduced through the suction port A into the rotor grooves 4 impinge on the bottom surface 4*c* and two opposite side surfaces 4*d* and 4*e* of each rotor groove 4 and are subjected to irregular reflection. At this time, direction is imparted to the gas molecules by an amount corresponding to the distance covered by the movement of the rotor 1. More specifically, as shown in FIG. 3, the gas molecules subjected to irregular reflection with a relative speed W in a relative coordinate system on the rotor 1 are acted on by the rotor 1 of a speed of movement U and spin off the rotor grooves 4 into the stator grooves 5 having a direction of an absolute speed c in a stationary coordinate system. The stator grooves 5 are oriented in a direction forming an obtuse angle with the direction of rotation of the rotor 1, so that the direction of the gas molecules spinning off the rotor grooves 4 matches the direction of orientation of the stator grooves 5, whereby the gas molecules readily flow through the stator grooves 5. In FIG. 2, the gas molecules spinning off one of the rotor grooves 4 with direction impinge on a bottom surface 5*c* and then two side surfaces 5*d* and 5*e* of one of the stator grooves 5, before being subjected to irregular reflection which causes the majority of the gas molecules to spin off the stationary groove 5 into the rotor groove 4 of the next stage. Some gas molecules might spin off the stator groove 5 into the rotor groove 4. However, since the direction imparted to the gas molecules by the movement of the rotor 1 is in reverse to the orientation of the grooves described hereinabove, the gas molecules experiences difficulty in flowing through the rotor and stator grooves 4 and 5 in an opposite direction. Thus, the gas molecules as a whole are transferred from the suction port A toward the discharge port B. A typical flow of gas molecules is indicated by arrows in FIG. 1. It will be seen that the gas molecules flow radially from one rotor groove 4 into one stator groove 5 and then from the one stator groove 5 into another rotor groove 4, and that this process is repeated until the gas molecules gradually shift axially toward the discharge port B. This flow of the gas molecules is entirely distinct from a flow of gas molecules taking place in a helical groove molecular pump and axial flow molecular pump of the prior art. In the turbomolecular pump according to the invention, surfaces of the rotor which impart direction to the gas molecules includes the bottom surface and two side surfaces of each rotor groove 4, so that the pump has an improved gas molecule transfer efficiency. Those gas molecules which flow in a back current from the discharge port B toward the suction port A impinge on the stator groove 5 before being introduced into the rotor groove 4, so that the rate of the gas molecules flowing in a back current is reduced. The turbomolecular pump according to the invention is characterized by the fact that these two features make it possible to increase the compression ratio per stage and the gas discharge speed. In the turbomolecular pump according to the invention, the stator 5 is located in face-to-face relationship to the outer peripheral surface of the rotor 4. By this arrangement, the need to employ a half structure for the stator 5 when the turbines are arranged in a plurality of stages is eliminated.

Figure 5:
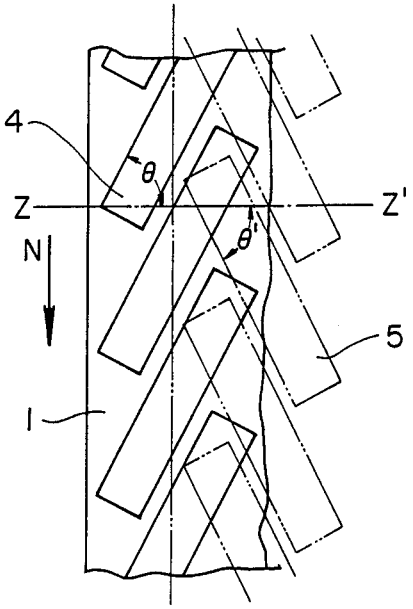
FIG. 5 is a developed view taken in the direction of arrows V—V in FIG. 4.
Figure 4:
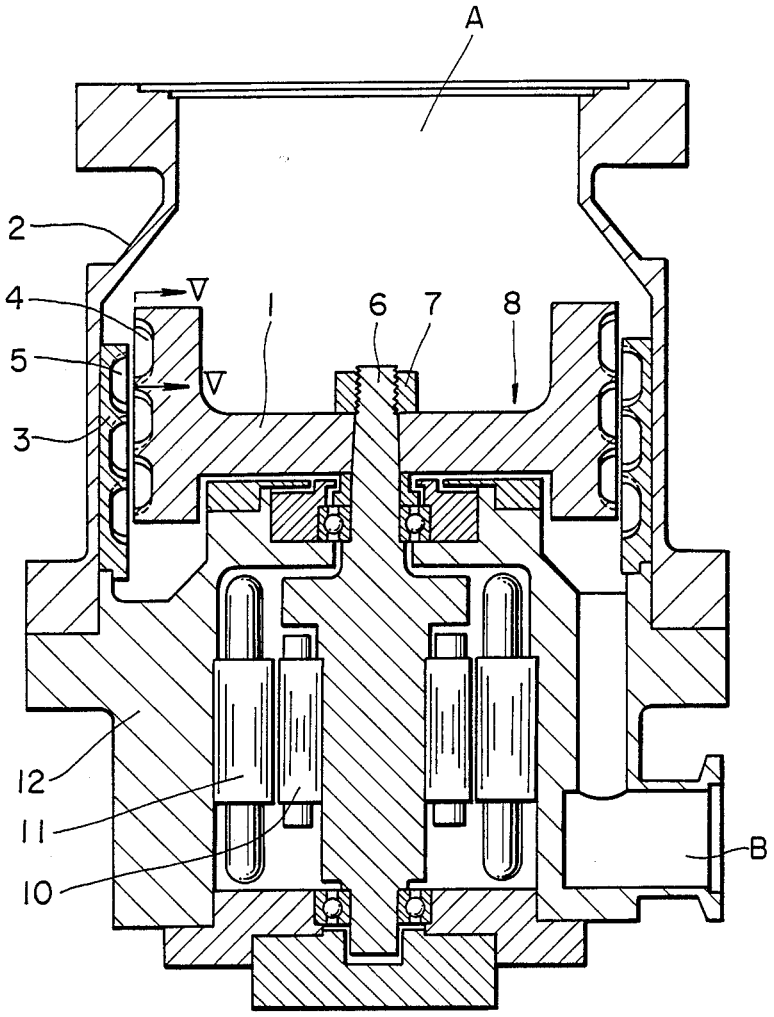
FIG. 4 is a vertical sectional view of a second embodiment of the turbomolecular pump in accordance with the invention.

The embodiment of FIGS. 4 and 5 differs from the first embodiment of FIGS. 2 and 3 in the configuration of the rotor grooves 4 and stator grooves 5. In FIGS. 4, 5, the rotor grooves 4 and stator grooves 5 are substantially rectangular in configuration and inclined at angles $\theta$ and $\theta'$ respectively, with respect to the center axis Z—Z' of the rotor 1 and overlap in part as viewed in the axial direction.

The rectangular configuration of the rotor grooves 4 and stator grooves 5 facilitates working on the surfaces of rotor 1 and stator 3 to provide the respective grooves 4 and 5, resulting in a cost reduction.

Figure 6:
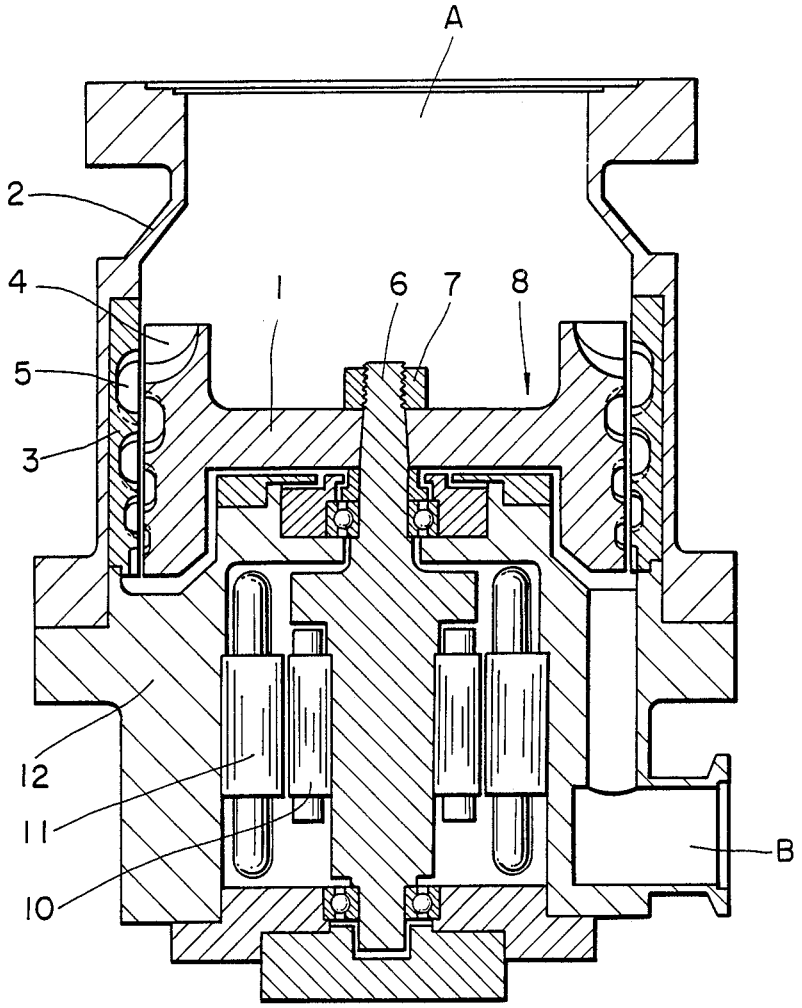
FIG. 6 is a vertical sectional view of a third embodiment of the turbomolecular pump in accordance with the invention.

In FIG. 6, the rotor grooves 4 and stator grooves 5 are configured in such a manner that the cross-sectional area of a channel of a molecular flow of gas constituted by each rotor groove 4 and each stator groove 5 successively becomes smaller in axially moving toward the discharge port B, and the rotor groove 4 of the initial stage on the suction side and the stator groove 5 of the terminating stage on the discharge side both open axially.

By virtue of the aforesaid construction of the rotor and stator grooves 4 and 5, it is possible to eliminate an unnecessary cross-sectional area of the channel on the discharge side where the gas molecules are compressed and the volume and flow rate of gas decrease. It is also possible to bring the rotating and stationary parts of the rotor grooves 4 and stator grooves 5 closer to each other, so that the pumping action performed by the turbines increases per head and the compression ratio becomes higher. The arrangement whereby the initial turbine stage on the suction side and the terminating turbine stage on the discharge side open axially enables gas molecules to readily flow axially to the turbine blades from the suction port and readily spin off the turbine blades.

Figure 7:
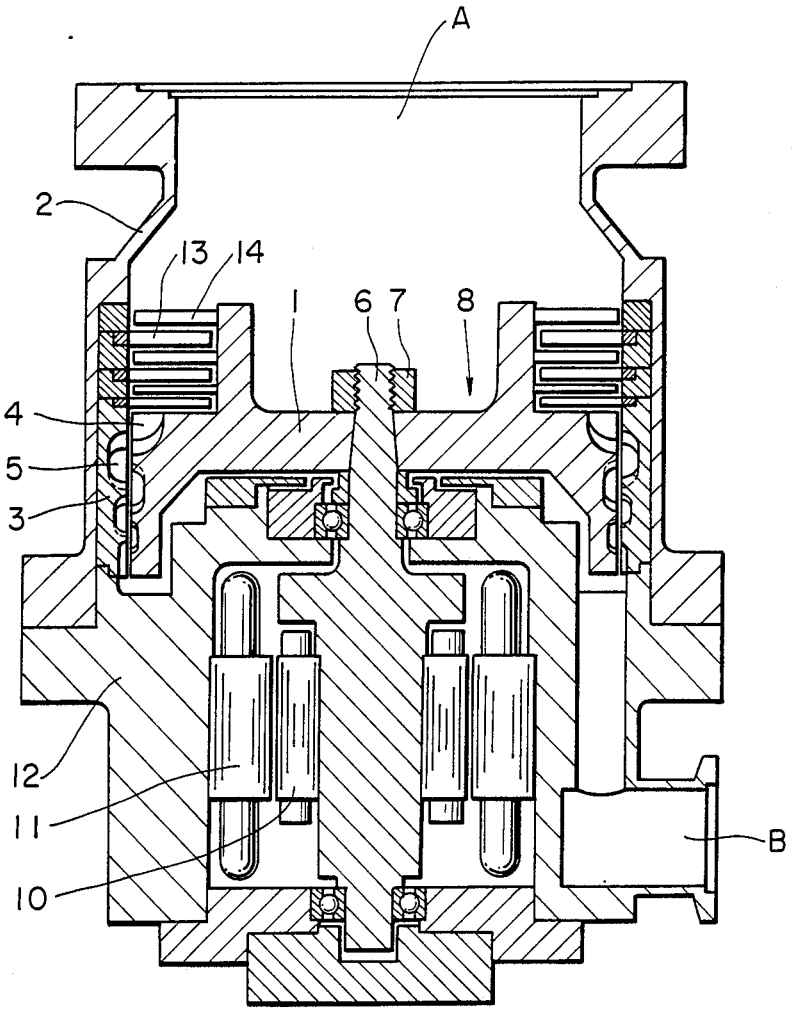
FIG. 7 is a vertical sectional view of a fourth embodiment of the turbomolecular pump in accordance with the invention.

In FIG. 7, a plurality of axial flow turbine blades are located on the suction side of the turbine grooves of the turbomolecular pump. More specifically, the casing 2 has stator blades 13 located in a plurality of stages axially of the rotor 6 on the inner wall surface thereof, and rotor blades 14 secured to the outer peripheral surface of the rotor 1 are each inserted between the two adjacent stator blades 13, to provide an axial flow turbine group. The rotor grooves 4 and stator grooves 5 of FIG. 6, for example, are located on the discharge side of the axial flow turbine group of the aforesaid construction.

In this construction, gas molecues introducted into the pump through the suction port A are transferred toward the discharge port B by the action of the stator blades 13 and rotor blades 14 of the axial flow turbine group and further compressed by the action of the rotor grooves 4 and stator grooves 5, before being discharged through the discharge port B.

The embodiment of FIG. 6 the advantage that a high vacuum can be readily achieved by the combined actions of the axial flow turbine group capable of increasing the gas discharge speed and the group of turbine grooves capable of increasing the compression ratio while being able to maintain the gas discharge speed at a desired level.

The present invention enables a high compression ratio and a high gas discahrge speed to be achieved. As compared with a molecular pump of the prior art having only a single group of turbine blades, the turbomolecular pump according to the invention is able to reduce the number of stages of turbine grooves, to enable an overall compact size to be obtained in a turbomolecular pump. A reduction in the overall size of the turbomolecular pump makes it possible to readily rotate the rotor at high speed.

From the foregoing description, it will be appreciated that, in the turbomolecular pump according to the invention, the rotor grooves are formed on the outer peripheral surface of the rotor in a manner to tilt at a predetermined angle with respect to the center axis of the rotor, and the stator grooves are formed in the inner surface of the stator facing the outer peripheral surface of the rotor and tilt at the same angle as the rotor grooves but are oriented in an opposite direction to the rotor grooves, with the rotor grooves and staror grooves overlapping in part as viewed in the axial direction. By virtue of this construction, the turbomolecular pump according to the invention is able to achieve a high compression ratio and a high pumping speed because the bottom and side surfaces of the rotor grooves and stator grooves are all concerned in transferring gas molecules.

What is claimed is:

1. A turbomolecular pump for evacuating a space, the turbomolecular pump comprising:

a casing;

a rotor in said casing extending axially thereof;

a stator in said casing located in face-to-face relation to said rotor;

a plurality of axially spaced circumferential rows of rotor grooves on an outer peripheral surface of said rotor, said rotor grooves in each row being equidistantly spaced from each other and tilting at a predetermined angle with respect to the axis of the rotor; and a plurality of axially spaced circumferential rows of stator grooves on a surface of said stator facing the rotor, said stator grooves in each row being equidistantly spaced from each other and tilting at the same angle as said rotor grooves but being oriented in an opposite direction to the rotor grooves;

said rows of rotor grooves and said rows of stator grooves being alternately arranged in axially staggered relation to each other, each of said rotor grooves in one of the rows having a portion extending from a position midway of the rotor groove to an end thereof on an outlet side, said portion of the rotor groove overlapping a first portion of a corresponding confronting one of said stator grooves and a corresponding one of the rows, said first portion of the stator groove extending from an end thereof on an inlet side to a position midway of the stator groove, the stator groove having a second portion extending from a position midway of the stator groove to an end of the outlet side, said second portion of the stator groove overlapping a portion of a corresponding confronting one of said rotor grooves in a subsequent row, which portion extends from an end of the rotor groove in a subsequent row on the inlet side to a position midway of the rotor groove in the subsequent row.

2. A turbomolecular pump as claimed in claim 1, wherein each said rotor groove and stator groove have a starting end and a terminating end as viewed axially, said staring end and terminating end being parallel to a plane perpendicular to the center axis of the rotor.

3. A turbomolecular pump as claimed in claim 1, wherein said rotor grooves and stator grooves are substantially rectangular in configuration as viewed by developing a cylinder, said rectangular rotor grooves and stator grooves tilting at the predetermined angle with respect to the center axis of said rotor and being equidistantly located to each other in a peripheral direction.

4. A turbomolecular pump as claimed in claim 1, wherein one of said rotor grooves constituting an initial stage on the suction side and one of said stator grooves constituting a terminating stage on the discharge side both open axially of the rotor.

5. A turbomolecular pump as claimed in claim 1, wherein each said rotor groove and stator groove have a smoothly curving surface extending from a starting end to a terminating end as viewed axially through a bottom surface.

6. A turbomolecular pump as claimed in claim 1, wherein one of said rotor grooves constituting an initial stage on the suction side and one of said stator grooves constituting a terminating stage on the discharge side both open axially of the rotor.

7. A turbomolecular pump as claimed in claim 1, wherein a channel for a molecular flow constituted by each said rotor groove and stator groove has its cross-sectional area reduced successively in going axially of the rotor toward the discharge side.

8. A turbomolecular pump as claimed in claim 1, further comprising an axial flow turbine group comprising a plurality of rotor blades and a plurality of stator blades located alternately, said axial flow turbine group being located on the suction side of the group of turbine grooves comprising rotor grooves on the rotor, and stator grooves on the stator extending annularly in face-to-face relation to the rotor.

9. A turbomolecular pump for evacuating a space, the turbomolecular pump comprising:

a casing;

a rotor in said casing extending axially thereof;

a stator in said casing located in face-to-face relation to said rotor;

a plurality of rotor grooves on an outer peripheral surface of said rotor, extending equidistantly in a spaced-apart relation to each other and tilting at a predetermined angle with respect to the axis of the rotor;

a plurality of stator grooves on a surface of said stator facing the rotor which extend equidistantly in a spaced-apart relationship to each other and tilt at the same angle as said rotor grooves but are oriented in an opposite direction to the rotor grooves, said rotor grooves and stator grooves are located alternately axially of the rotor, and said rotor grooves and stator grooves overlap in part as viewed axially of the rotor; and wherein a channel for a molecular flow constituted by each of said rotor groove and stator groove has a cross-sectional area thereof reduced successively in going axially of the rotor toward the discharge side.

10. A turbomolecular pump for evacuating a space, the turbomolecular pump comprising:

a casing;

a rotor in said casing extending axially thereof;

a stator in said casing located in face-to-face relation to said rotor;

a plurality of rotor grooves on an outer peripheral surface of said rotor, extending equidistantly in a spaced-apart relation to each other and tilting at a predetermined angle with respect to the axis of the rotor;

a plurality of stator grooves on a surface of said stator facing the rotor which extend equidistantly in a spaced-apart relationship to each other and tilt at the same angle as said rotor grooves but are oriented in an opposite direction to the rotor grooves, said rotor grooves and stator groove overlapping in part as viewed axially of the rotor;

an axial flow turbine group comprising a plurality of rotor blades and a plurality of stator blades located alternately, said axial flow turbine group being located on a suction side of the group of turbine grooves comprising rotor grooves on the rotor, and stator grooves on the stator extending annularly in face-to-face relation to the rotor.

* * * * *